US006398671B1

(12) United States Patent
Rios

(10) Patent No.: US 6,398,671 B1
(45) Date of Patent: Jun. 4, 2002

(54) SELF-LOADING PRACTICE BATTING TEE

(76) Inventor: Johnny Rios, 3510 Via Real, Carpinteria, CA (US) 93013

( * ) Notice: Subject to any disclaimer, the term of this patent is extended or adjusted under 35 U.S.C. 154(b) by 0 days.

(21) Appl. No.: 09/547,067

(22) Filed: Apr. 11, 2000

(51) Int. Cl.[7] ..... A63B 69/00

(52) U.S. Cl. ..... 473/417; 473/133; 473/138; 473/422; 273/317.6; 273/407

(58) Field of Search ..... 473/417–431, 473/FOR 102, FOR 103, FOR 108, FOR 109, 393, 396, 138–144; 273/317.2, 317.6, 332, 390, 391, 407

(56) References Cited

U.S. PATENT DOCUMENTS

| | | | | | |
|---|---|---|---|---|---|
| 2,976,041 | A | * | 3/1961 | White | 473/417 |
| 3,489,411 | A | * | 1/1970 | Morelli et al. | 473/417 |
| 4,383,686 | A | * | 5/1983 | Cardieri | 473/417 |
| 4,993,708 | A | * | 2/1991 | Prosser et al. | 473/417 |
| 5,415,396 | A | * | 5/1995 | Huang | 473/417 |
| 5,580,047 | A | * | 12/1996 | Shih et al. | 473/417 |
| 5,772,536 | A | * | 6/1998 | Wang | 473/417 |
| 5,800,288 | A | * | 9/1998 | Mims | 473/417 |

* cited by examiner

*Primary Examiner*—Paul T. Sewell
*Assistant Examiner*—Mitra Aryanpour

(74) *Attorney, Agent, or Firm*—Michael G. Petit

(57) ABSTRACT

An automatic teeing apparatus for a ball. A ball, preferably a baseball or softball, is affixed to one end of an elastic cord such as, for example, a "bungee" cord. The opposing end of the elastic cord is affixed to a stable platform or base plate adapted to support the teeing apparatus on the ground. The length of the elastic cord between the ball and the base portion is coaxially housed within a hollow, substantially cylindrical flexible pedestal mounted in a vertically upright position on the base portion. In a preferred embodiment of the device, the pedestal, the height of which is telescopically adjustable, includes a coil spring having a lower end rigidly affixed to the base portion and an upper end in opposition thereto. A rigid cylindrical tubular member has a lower end, which is concentrically disposed within the upper end of the coil spring and is adjustably attached thereto to permit telescopic adjustment of the tubular member within the coil spring. The upper end of the tubular member extends upwardly from the upper end of the coil spring, and matingly engages the lower end of a sturdy, slightly flexible hose, which fits snugly over the upper end of the tubular member. The open upper end of the hose provides a seat for supporting and presenting a spherical ball. The elastic cord is coaxially disposed within the pedestal and provides an elastic restoring force sufficient to stabilize the ball within the seat before the ball is struck and return the ball to the seat after the ball is struck by a bat.

3 Claims, 4 Drawing Sheets

SELF-LOADING PRACTICE BATTING TEE

BACKGROUND OF THE INVENTION

1. Field of the Invention

The present invention relates to sports training equipment and more particularly to a ball presentation device.

2. Prior Art

Developing hand-eye coordination is an important exercise in sports such as baseball, softball, golf and tennis. In recognition of the importance of this skill, many practice devices have been developed to provide means for developing hand-eye coordination and perfecting a complex body motion such as swinging a bat, club or racquet. Stationary baseball teeing devices are well known in the art and are used for presenting a ball to a batter in the sport known as "T-ball". T-ball is a sport that enables its practitioners to develop and perfect swing mechanics as well as hand-eye coordination.

To encourage and facilitate batting practice, a number of "automatic" teeing devices have been proposed. Representative examples of such devices are disclosed in U.S. Pat. Nos.: 6,033,323, 6,024,657, 5,997,419, 5,951,413, 5,928,092, 5,916,045, 5,897,444 and 5,882,270. These prior art devices generally include a tubular member mounted on a base platform, which may be shaped like a home plate. The ball is normally supported on the upper end of the tube and positioned within the batters "strike zone". Alternatively, the tube may be adjustable in length and/or mounted on a plate, which plate is movably attached to the base platform whereby the distance of the ball from the batter may also be varied.

Notwithstanding the plethora of devices that have been developed for batting practice, all suffer from one or more disadvantages. Devices that are operable for re-teeing a struck ball are expensive to manufacture and/or can cause injury to the batter or damage to the bat or device if the device is accidentally struck by the batter. There remains a need for a ball presentation device that overcomes these problems.

SUMMARY

It is a first object of the invention to provide a device that will enable a batter to practice hitting a ball with a bat.

It is a further objective of the invention to provide a device which will enable a batter to hit a ball repetitively without requiring the batter to reposition the ball between successive swings.

It is yet a further object of the invention to provide a batting practice device meeting the above-stated objectives and can be used in a restricted space.

It is another object of the invention to provide a ball teeing and presentation device that is simple in design, has minimal moving parts, is durable and which is inexpensive to manufacture.

It is still a further object of the invention to provide a ball presentation device that is adjustable in height.

It is another object of the invention to provide a ball presentation device which may be used by either a right or left-handed batter.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
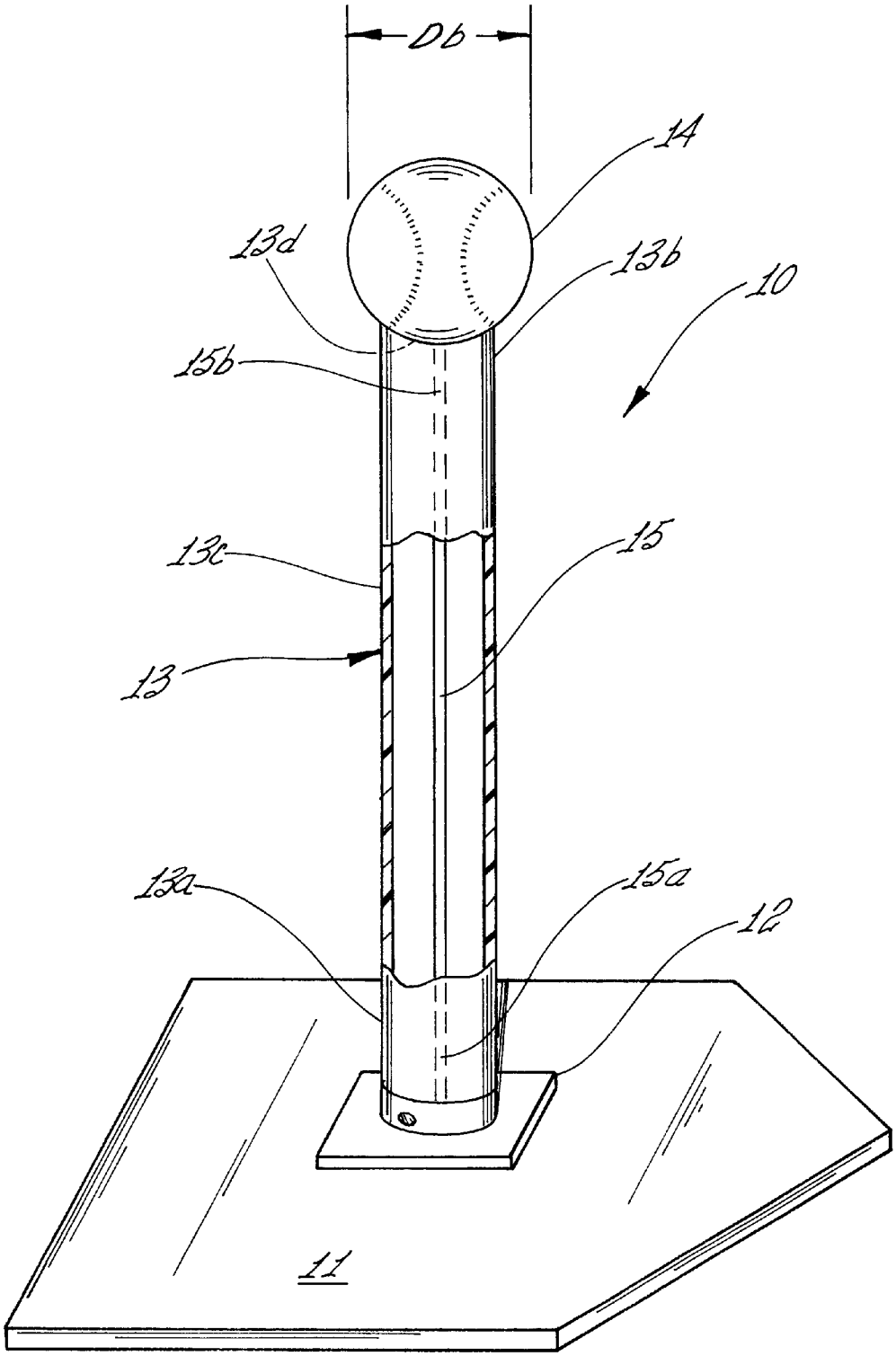
FIG. 1 is a perspective partially cutaway view of a ball teeing and presentation device in accordance with a preferred embodiment of the present invention.

Turning now to FIG. 1, a ball presentation device operable for supporting and presenting a ball to a batter (not shown) in a position to be struck by a bat is illustrated in partially cutaway perspective view at numeral 10. The device 10 includes a base plate 11 having a pedestal-mounting bracket 12 affixed thereto. A hollow, flexible pedestal 13 has a lower portion 13*a* affixed to the pedestal mounting bracket 12, and an upper portion 13*b* having a circular opening 13*d* in the uppermost end thereof. The pedestal 13 further includes a middle portion 13*c* connecting the upper and lower portions thereof. A ball 14 having a ball diameter Db is disposed over the circular opening 13*d* in the end of the upper portion 13*b* of the pedestal and supported by the pedestal 13. A tensioned, extensible elastic cord 15, disposed coaxially within the pedestal 13 and coextensive with the length thereof, has a lower end 15*a* which is attached to the base plate 11 and an upper end 15*b* which is affixed to the ball 14, and a cord body portion therebetween.

When a bat strikes the ball 14, a portion of the kinetic energy of the bat is transferred to the ball. In response, the ball is set in motion and launched from the pedestal. The elastic cord attached to the ball stretches until the kinetic energy in the ball is transformed into potential energy stored in the (elastically) stretched cord 15. As the kinetic energy of the ball is transferred to the cord, a portion of the transferred energy is also transferred to the pedestal through the point of contact therebetween. If the pedestal 13 is made sufficiently flexible, as for example, by fabricating the pedestal from a high durometer reinforced rubber, the pedestal will elastically deform thereby dissipating a portion of the energy and reduce the tension on the elastic cord. In addition, if the bat strikes the pedestal, the pedestal can flex thereby preventing damage to the bat or the device.

Figure 2:
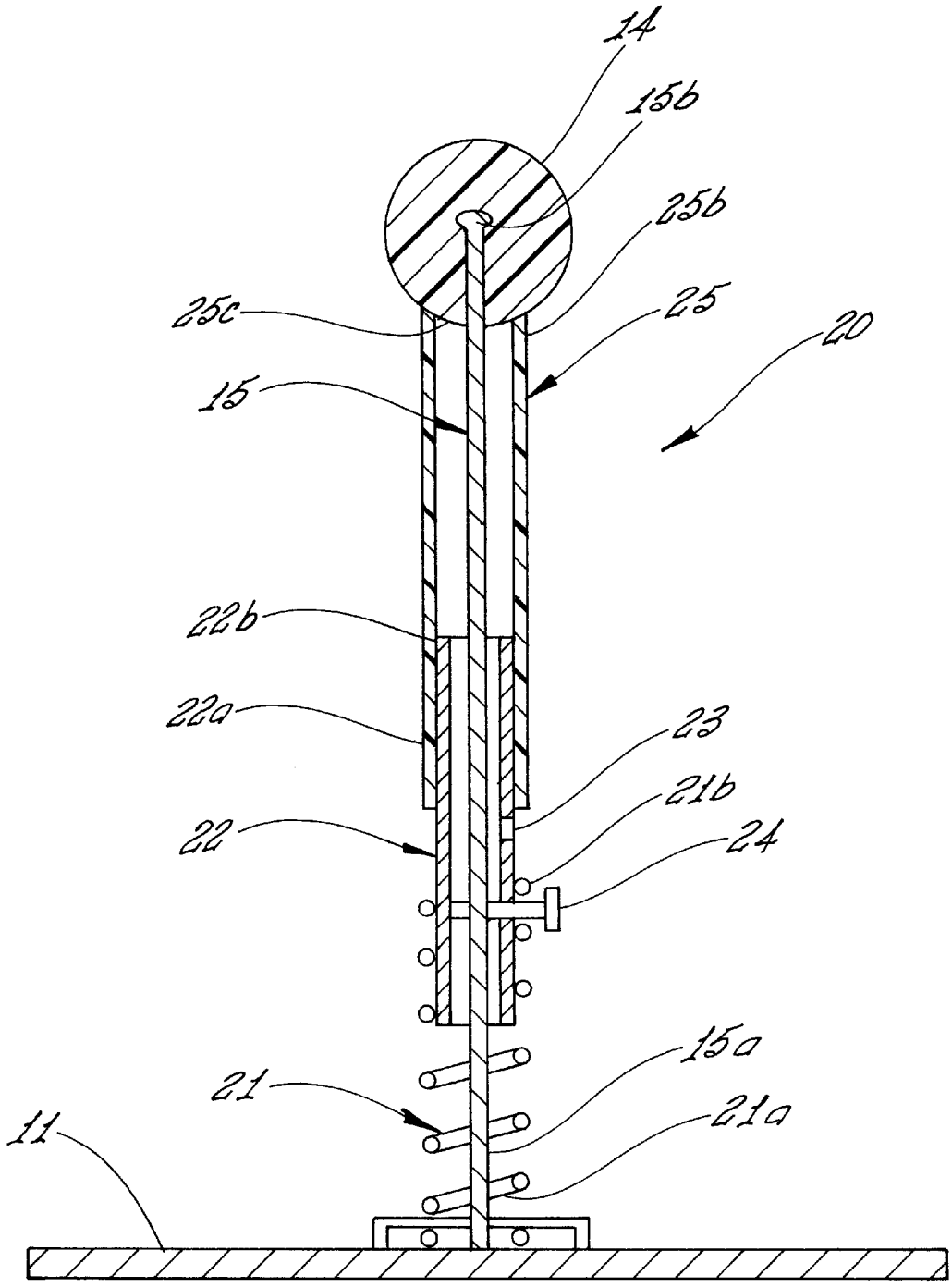
FIG. 2 is a front cross-sectional view of a ball teeing and presentation device in accordance with a preferred embodiment of the present invention.

As stated above, it is an object of the invention to provide a ball presentation device, which is height adjustable and durable. With reference now to both FIGS. 1 and 2, FIG. 2 illustrates, in cross-sectional view, a particularly preferred embodiment 20 of the device. In the preferred embodiment 20, the lower portion 13*a* of the pedestal 13 of the embodiment 10 of FIG. 1, is replaced with a stiff, cylindrical coil spring 21 having a lower end 21*a* attached to the base plate 11 by means of the pedestal mounting bracket 12, and an upper portion 21*b*. The middle portion of the pedestal (13*c* in the embodiment 10 of FIG. 1) is a rigid cylindrical tube

22 having a lower end 22*a,* having a plurality of height adjustment apertures 23 in the wall thereof disposed concentrically within the upper portion 21*b* of the coil spring 21 and adjustably attached thereto by a locking pin 24. The rigid cylindrical tube 22 has an upper portion 22*b,* which extends upwardly from the upper portion 21*b* of the coil spring 21. The upper portion of the pedestal (13*b* in the embodiment 10 of FIG. 1) comprises a flexible hose 25 having a lower end 25*a* concentrically disposed over the upper end 22*b* of the rigid cylindrical tube 22, and an upper end 25*b* having a circular opening 25*c* therein. The circular opening 25*c* underlies the ball 14 and has a diameter, which is less than the ball diameter Db.

Figure 3:
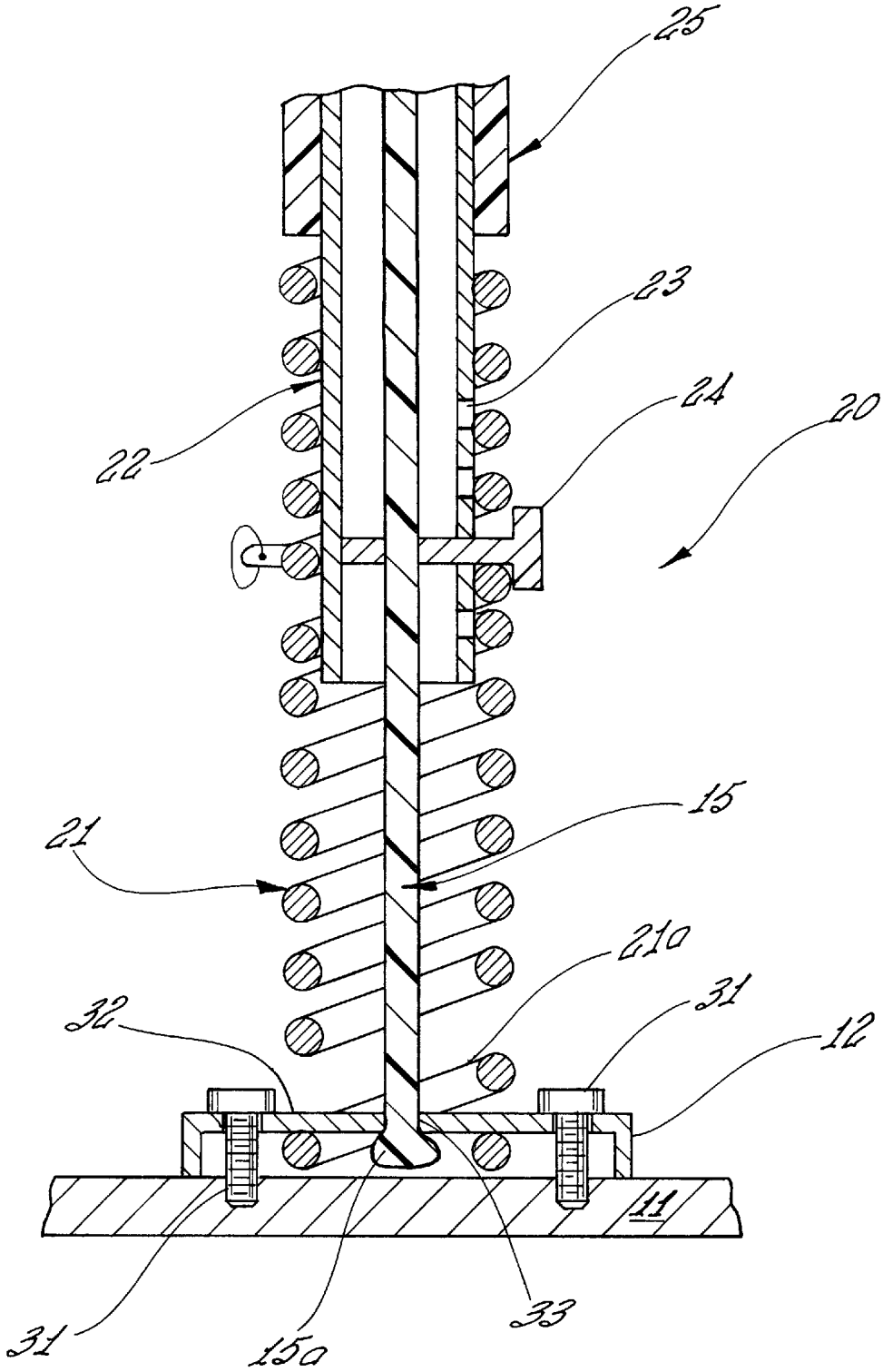
FIG. 3 is a cross-sectional view of the lower portion of the pedestal showing the attachment of the pedestal to the base plate and the cylindrical tube to the coil spring.

With reference now to FIG. 3, the bracket 12 has a slot 32 therein through which a coil 21*a* on the coil spring 21 passes. The lower end 15*a* of the elastic cord 15 is expanded below an aperture 33 in the bracket 12, and extends upwardly through the aperture 33. The bottom coil of the coil spring is reshaped to lay in a plane that is perpendicular to the central axis of the coil spring. The bracket 12 forces the bottom coil against the base plate 11, thereby supporting the coil spring and pedestal in a vertically upright position. The cylindrical tube 22, which fits snugly within the coil spring and is held in position by frictional contact with the inner surface of the coil spring, has a plurality of apertures 23 in the wall thereof. The apertures 23, together with the locking pin 24, enable height adjustment of the pedestal. Alternatively, the lower end of the hose and the upper portion of the cylindrical tube can be similarly apertured to receive the locking pin and provide height adjustment means. The apertures 23 are preferably off-center to reduce wear on the elastic cord through contact with the locking pin 24.

All portions comprising the pedestal in the preferred embodiment 20 are symmetrically disposed with respect to the central axis of the pedestal defined by position of the elastic cord. The inner diameter of both the coil spring 21 and the hose 25 are substantially equal to the outer diameter of the cylindrical tube 22. While frictional contact between the components comprising the pedestal is sufficient to maintain structural integrity of the pedestal when the device 20 is in use, it is desirable to provide positive (i.e. non-frictional) locking means between the components to ensure the structural integrity of the pedestal.

Figure 4:
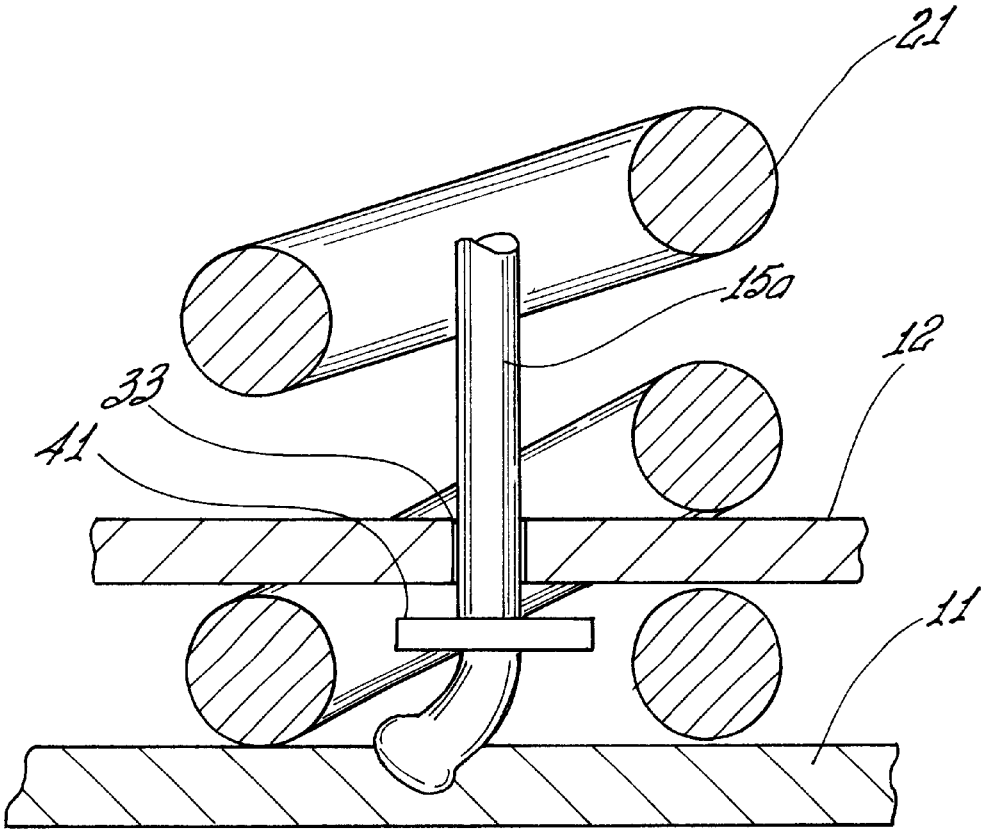
FIG. 4 is a partially cutaway view of the device illustrating a elastic cord clamp used to adjust the length of the cord to vary tension therein.
Figure 5:
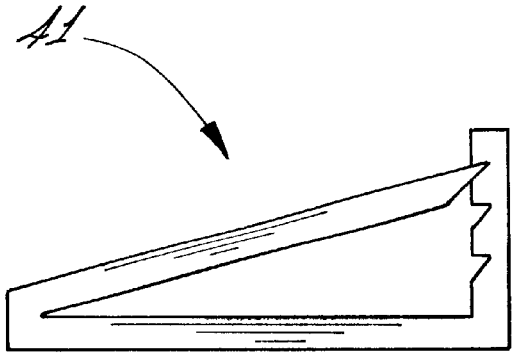
FIG. 5 is a top view of an embodiment of a simple pinch clamp useful for adjusting tension in the elastic cord.

The elasticity of the cord 15 may vary, depending on the age of the cord and environmental factors. For example, in warm weather, the cord may be less elastic than in colder weather. Accordingly, it is advantageous to provide means for adjusting the tension in the cord to adapt to the appropriate tension for operation of the device. FIG. 4 illustrates an example of such a tension adjustment means comprising a pinch clamp 41 that is attached to the lower end 15*a* of the cord 15 to permit adjustment of tension in the cord 15. The pinch clamp 41, preferably made of a slightly flexible plastic, shown in top view in FIG. 5, may, further include a grasping inner surface and positive locking means.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A ball presentation device operable for supporting and presenting a ball to a batter in a position to be struck by a bat, and wherein after the batter strikes the ball the device automatically returns the ball to said position, comprising:

(f) a base plate:

(g) a pedestal mounting bracket affixed to said base plate;

(h) a hollow flexible pedestal having a lower portion affixed to said pedestal mounting bracket, an upper portion having a circular opening therein, and a middle portion therebetween;

(i) a ball having a ball diameter disposed over said circular opening; and (j) a tensioned elastic cord disposed coaxially within said pedestal and having a lower end affixed to said base plate, and an upper end affixed to said ball, wherein said lower portion of said pedestal is a cylindrical coil spring having a lower end attached to said pedestal mounting bracket and an upper end, and wherein said middle portion of said pedestal comprises a rigid cylindrical tube having a lower end disposed concentrically within said upper end of said coil spring and adjustably attached thereto, and an upper end.

2. The ball presentation device of claim 1 wherein said upper portion of said pedestal comprises a flexible hose having a lower end concentrically disposed over said upper end of said rigid cylindrical tube, and an upper end having a circular opening therein wherein said circular opening underlies said ball and has a diameter which is less than said ball diameter.

3. The ball presentation device of claim 2 further comprising means operable for adjusting tension in said elastic cord.

* * * * *